US008317038B2

(12) United States Patent
Luberto et al.

(10) Patent No.: US 8,317,038 B2
(45) Date of Patent: Nov. 27, 2012

(54) MODULAR DISPLAY AND DISPENSING APPARATUS WITH PLURAL DISPENSING TIERS

(75) Inventors: Michael D. Luberto, Rivervale, NJ (US); Anthony V. Sainato, Pittsburgh, PA (US)

(73) Assignee: Henschel-Steinau, Inc., Allendale, NJ (US)

( * ) Notice: Subject to any disclaimer, the term of this patent is extended or adjusted under 35 U.S.C. 154(b) by 273 days.

(21) Appl. No.: 12/612,945

(22) Filed: Nov. 5, 2009

(65) Prior Publication Data

US 2011/0100941 A1 May 5, 2011

(51) Int. Cl.
*A47F 1/04* (2006.01)

(52) U.S. Cl. ..... 211/59.3; 312/61

(58) Field of Classification Search ..... 211/11, 211/59.2, 59.3, 59.4, 126.13, 175, 184, 189; 108/60, 61; 221/227, 255; 312/60, 61, 71, 312/86

See application file for complete search history.

(56) References Cited

U.S. PATENT DOCUMENTS 1,745,784 A * 2/1930 Davis ..... 211/182
1,911,368 A * 5/1933 Kress ..... 211/59.2
2,083,997 A * 6/1937 Kahan ..... 108/60
2,112,498 A * 3/1938 Wilson ..... 312/352
2,386,396 A * 10/1945 Holabird et al. ..... 108/60
2,502,261 A * 3/1950 Irwin ..... 108/61
2,721,632 A * 10/1955 Surpierre ..... 403/217
2,797,819 A * 7/1957 Lowmaster ..... 211/135
2,839,350 A * 6/1958 Hill et al. ..... 312/351
2,934,212 A * 4/1960 Jacobson ..... 211/59.3
3,035,587 A 5/1962 Schade
3,308,961 A 3/1967 Chesley
3,393,808 A * 7/1968 Chirchill ..... 211/59.2
3,631,821 A * 1/1972 Zachariou ..... 108/152
3,754,517 A * 8/1973 Hassel et al. ..... 108/61
3,784,022 A * 1/1974 Beesley, Jr. ..... 211/59.2
3,872,802 A * 3/1975 Scheerhorn et al. ..... 108/61
4,105,126 A * 8/1978 Deffner et al. ..... 211/59.2
4,193,650 A * 3/1980 Gray et al. ..... 312/205
4,598,828 A * 7/1986 Young et al. ..... 211/59.2
D290,566 S * 6/1987 Nathan et al. ..... D6/492
D290,790 S * 7/1987 Nathan et al. ..... D6/408
4,830,201 A 5/1989 Breslow
4,856,746 A * 8/1989 Wrobel et al. ..... 248/250
5,190,186 A 3/1993 Yablans et al.
5,199,584 A * 4/1993 Fowler et al. ..... 211/184
5,299,509 A * 4/1994 Ballard ..... 108/182
5,469,976 A 11/1995 Burchell
5,833,076 A 11/1998 Harres et al.

(Continued)

*Primary Examiner* — Darnell Jayne
*Assistant Examiner* — Joshua Rodden
(74) *Attorney, Agent, or Firm* — Arthur Jacob

(57) ABSTRACT

A modular apparatus displays and dispenses merchandise at first and second dispensing locations placed at plural dispensing tiers at a point-of-purchase adjacent a display shelf. A first pusher-track assembly extends along a first path of travel of first serially arranged packages, and dividers are spaced apart to straddle the first path of travel and the first serially arranged packages. A second pusher-track assembly is secured to each of the dividers, elevated altitudinally above the first pusher-track assembly, and extends along a second path of travel of second serially arranged packages. A securing arrangement integrates the second pusher-track assembly with the dividers within the apparatus, and a stabilizing arrangement stabilizes the dividers against inadvertent movements relative to the display shelf to complete a stable apparatus. Multiple dividers and counterpart pusher-track assemblies enable the modular apparatus to provide any selected number of display and dispensing bays.

17 Claims, 9 Drawing Sheets

U.S. PATENT DOCUMENTS

| | | | | |
|---|---|---|---|---|
| 6,041,720 | A | 3/2000 | Hardy | |
| 6,142,317 | A | 11/2000 | Merl | |
| 6,648,151 | B2 | 11/2003 | Battaglia et al. | |
| 6,991,115 | B2 * | 1/2006 | Chow et al. | 211/40 |
| 7,063,217 | B2 | 6/2006 | Burke | |
| 7,124,898 | B2 * | 10/2006 | Richter et al. | 211/59.3 |
| 7,216,770 | B2 * | 5/2007 | Mueller et al. | 211/59.3 |
| 7,500,571 | B2 * | 3/2009 | Hawkinson | 211/59.3 |
| 7,665,618 | B2 * | 2/2010 | Jay et al. | 211/59.2 |
| 2003/0150830 | A1 * | 8/2003 | Crown et al. | 211/175 |
| 2005/0098515 | A1 | 5/2005 | Close | |
| 2006/0196840 | A1 * | 9/2006 | Jay et al. | 211/59.2 |
| 2007/0090068 | A1 * | 4/2007 | Hardy | 211/59.3 |
| 2007/0138114 | A1 * | 6/2007 | Dumontet | 211/59.3 |
| 2008/0017598 | A1 * | 1/2008 | Rataiczak et al. | 211/59.3 |
| 2010/0258513 | A1 * | 10/2010 | Meyer et al. | 211/59.3 |
| 2011/0147323 | A1 * | 6/2011 | Sainato et al. | 211/59.2 |
| 2011/0174750 | A1 * | 7/2011 | Poulokefalos | 211/59.3 |

* cited by examiner

MODULAR DISPLAY AND DISPENSING APPARATUS WITH PLURAL DISPENSING TIERS

BACKGROUND OF THE INVENTION

1. Field of the Invention

The present invention relates generally to point-of-purchase display and dispensing of merchandise and pertains, more specifically, to apparatus for enabling the display and ready dispensing of serially arranged merchandise packages at plural dispensing tiers at a point-of-purchase dispensing location.

An ever-increasing variety of packaged merchandise offered for sale at points-of-purchase locations along store shelves has led to a requirement for better organization of such merchandise. Among the more prevalent display and dispensing apparatus currently in use on store shelves are those employing pusher-track assemblies to advance serially arranged merchandise packages along a path of travel to a dispensing location placed at the point-of-purchase. Accordingly, in many retail sales environments, pusher-track display and dispensing devices are placed upon shelves at point-of-purchase locations.

2. Description of Related Art

Because linear shelf space at such locations usually is at a premium, the placement of pusher-track display and dispensing devices, under current common practice, is restricted to selected, assigned segments of the length of a display shelf, thereby taking advantage of only the limited linear space available along an assigned segment of shelf length. It would be advantageous to be able to utilize as much of the shelf space as possible, of that space made available at any length of shelf space assigned to a particular product to be offered at a point-of-purchase location. Most present display and dispensing devices which utilize a pusher-track assembly system are not constructed so as to take full advantage of vertical space available above a display shelf while still providing the versatility of modular construction to accommodate a variety of different products offered in merchandise packages.

BRIEF SUMMARY OF THE INVENTION

The present invention provides an improvement in display and dispensing apparatus which enables effective use of pusher-track advancement of merchandise packages while increasing capacity along an assigned length of shelf by utilizing the space available vertically above the assigned length of display shelf at a point-of-purchase location through providing plural, tiered dispensing paths feeding into corresponding plural dispensing locations. As such, the present invention attains several objects and advantages, some of which are summarized as follows: Provides modular display and dispensing apparatus for attaining enhanced utilization of space available at assigned linear lengths of display shelf space in a retail sales environment, employing pusher-track feed systems; enables efficient and effective display and dispensing of merchandise articles, utilizing pusher-track feed at point-of-purchase locations where linear shelf space is limited; establishes an aesthetically attractive and efficient use of assigned shelf space, with increased capacity and added convenience in utilizing a modular arrangement of pusher-track assemblies to feed merchandise articles at such shelf locations; facilitates the organization of merchandise for display and dispensing at a point-of-purchase located along store shelves; provides simplified plural-tiered pusher-track apparatus constructed economically of fewer component parts; allows ease of set-up and use for accommodating a wide variety of merchandise displayed and dispensed along plural tiers at a point-of-purchase; enables pusher-track feed of merchandise articles along plural tiered paths of travel toward corresponding plural dispensing locations for more versatile dispensing of such merchandise articles; makes more efficient use of space available along display shelf locations, with pusher-track feed display and dispensing of merchandise articles offered for sale at such locations; increases the capacity available for pusher-track feed in display and dispensing apparatus placed upon a display shelf at a point-of-purchase location, without requiring an increase in the length of shelf space occupied by the display and dispensing apparatus; provides the versatility of modular construction in a plural-tiered pusher-track display and dispensing apparatus; minimizes the number and complexity of component parts in a modular display and dispensing apparatus which provides plural dispensing tiers for better space utilization; provides a modular pusher-track feed display and dispensing apparatus of increased capacity at a given display shelf location for reliable operation over an extended service life.

The above objects and advantages, as well as further objects and advantages, are attained by the present invention, which may be described briefly as a modular apparatus for displaying and dispensing merchandise at plural dispensing tiers at a point-of-purchase adjacent a display shelf extending in lateral directions, the merchandise being in the form of packages arranged serially along each of at least first and second paths of travel spaced apart altitudinally and extending longitudinally toward corresponding first and second forward dispensing locations spaced apart altitudinally and placed at the point-of-purchase, the apparatus comprising: a first pusher-track assembly for extending along a longitudinal direction adjacent the first path of travel in juxtaposition with first serially arranged packages; a first securing arrangement for securing the first pusher-track assembly at a selected lateral location along the display shelf; at least two dividers for extending along the longitudinal direction, spaced apart in a lateral direction, to straddle the first path of travel, in juxtaposition with the first serially arranged packages, each divider including a lower edge for juxtaposition with the display shelf and an upper edge for being spaced altitudinally above the display shelf when the lower edge is juxtaposed with the display shelf; a divider-securing arrangement for securing each divider at a selected divider lateral location along the display shelf; a second pusher-track assembly for extending along a longitudinal direction adjacent the second path of travel in juxtaposition with second serially arranged packages; and a second securing arrangement for selectively securing the second pusher-track assembly to each of the dividers, elevated altitudinally above the first pusher-track assembly, and placed altitudinally between the lower edge and the upper edge of each divider to extend along the second path of travel, such that upon securing the dividers in place along the longitudinal direction, straddling the first path of travel, and securing the second pusher-track assembly between the dividers, the divider-securing arrangement and the second securing arrangement will integrate the second pusher-track assembly with the dividers within the apparatus, with the first and second forward dispensing locations spaced apart altitudinally to establish the plural dispensing tiers at the point-of-purchase.

BRIEF DESCRIPTION OF THE SEVERAL VIEWS OF THE DRAWING

The present invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
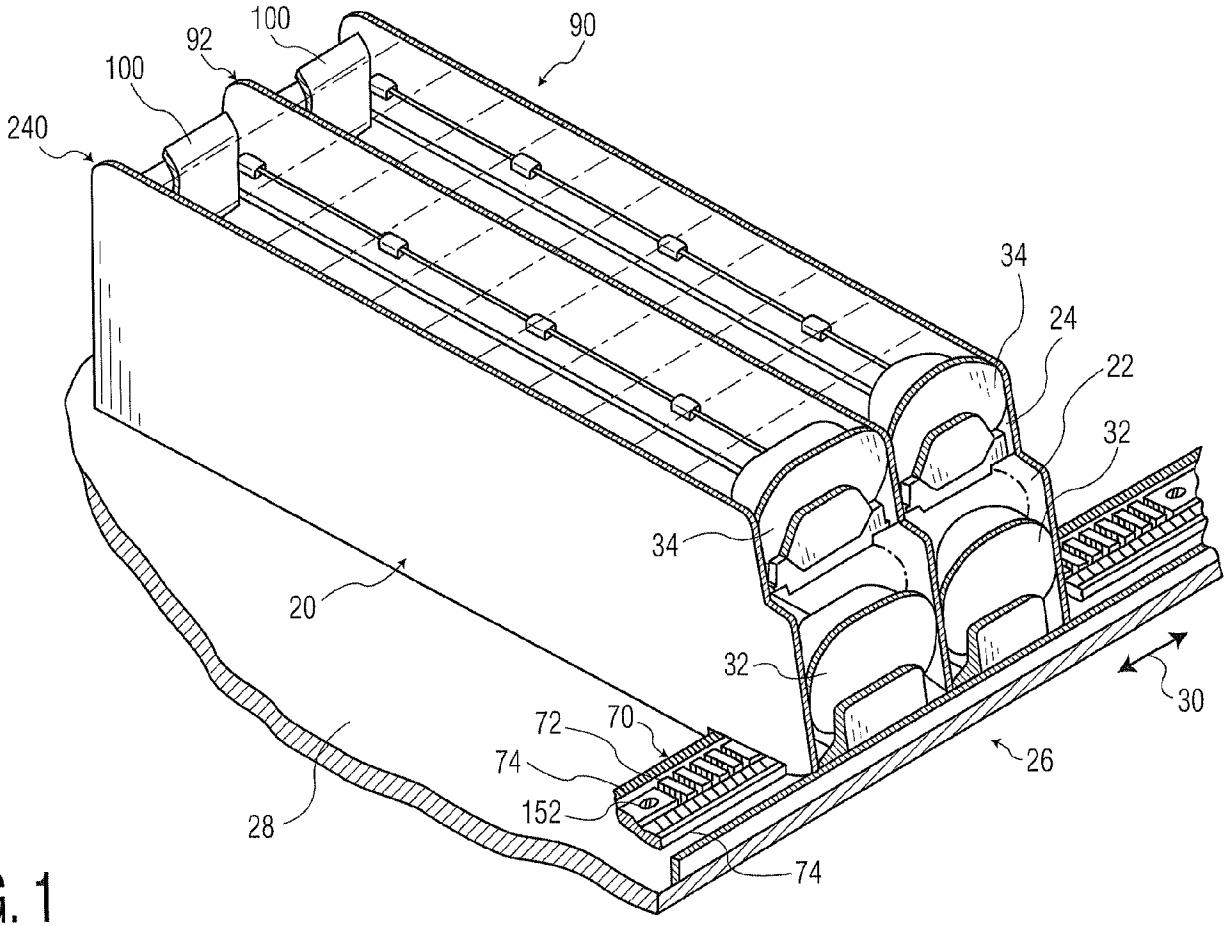
FIG. 1 is a pictorial view of a modular apparatus with plural tiers for displaying and dispensing merchandise constructed in accordance with the present invention.
Figure 2:
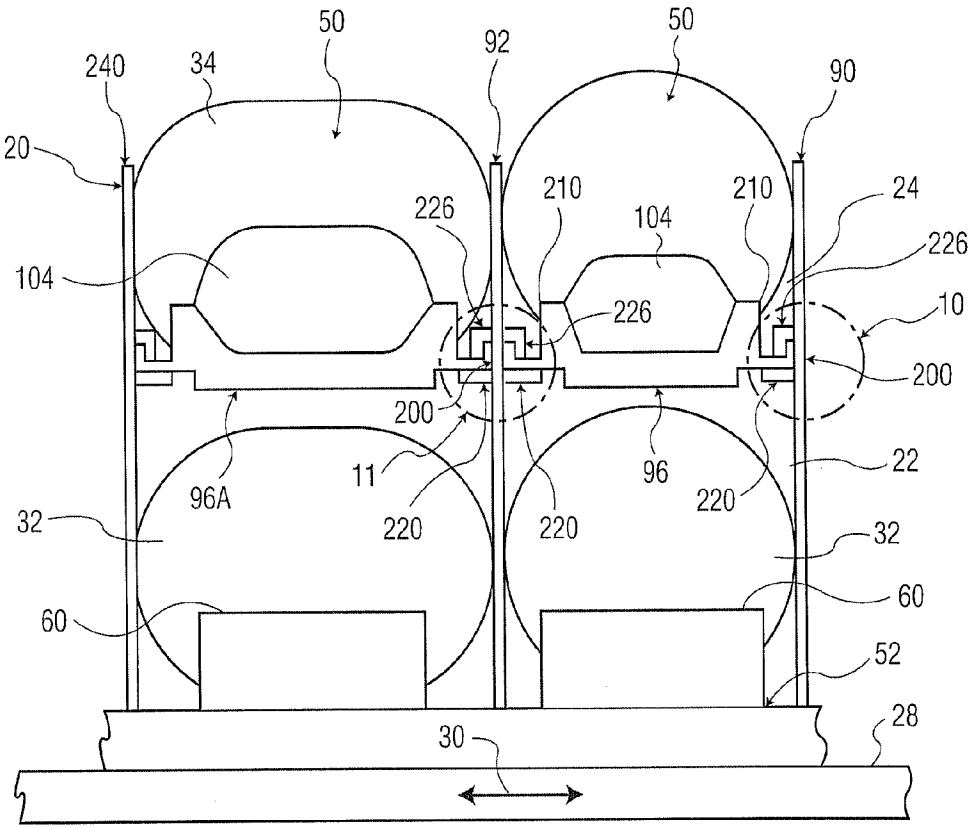
FIG. 2 is a front elevational view of the apparatus.
Figure 3:
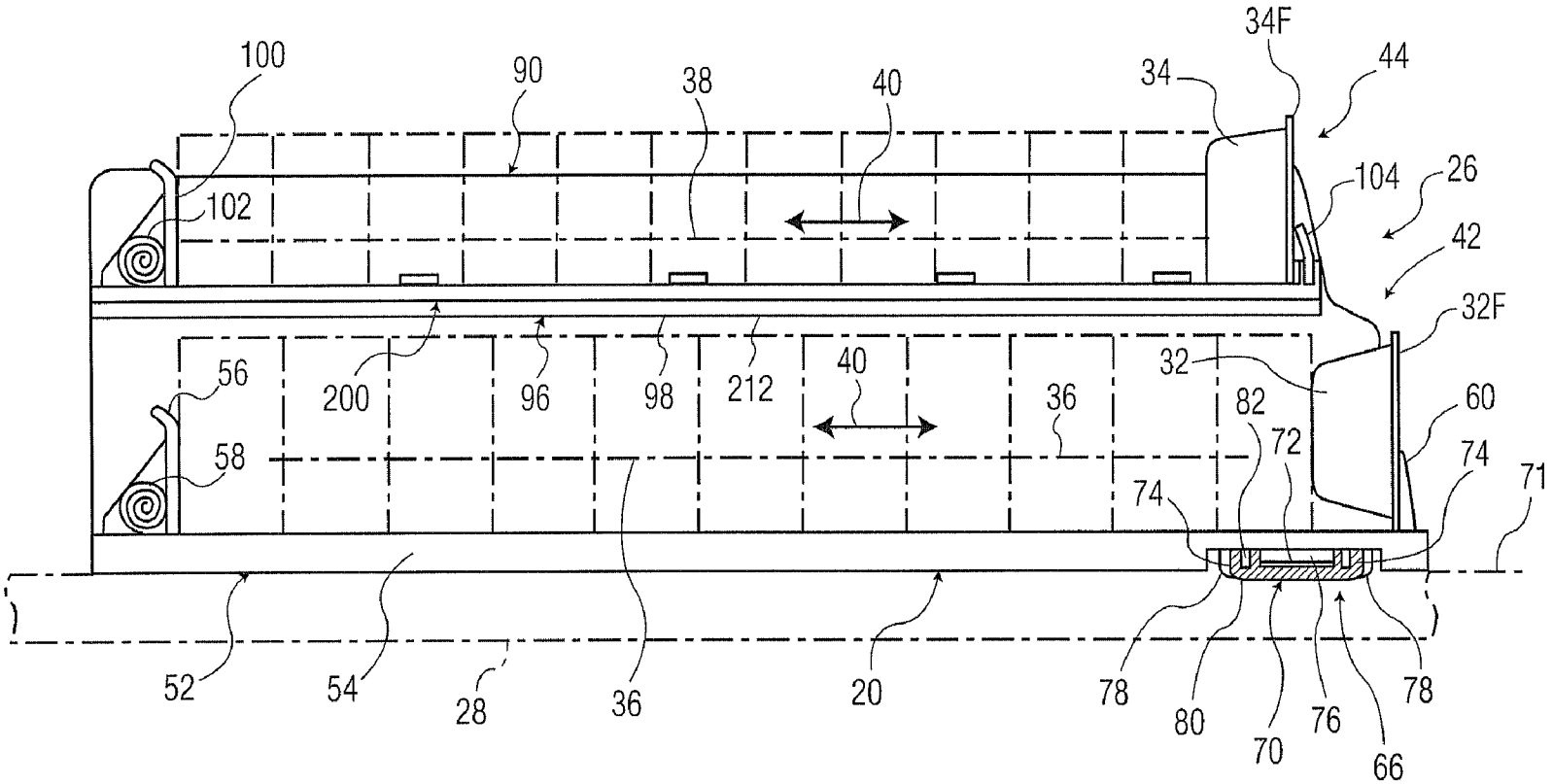
FIG. 3 is a side elevational view, partially diagrammatic, of the apparatus, with component parts removed to reveal interior details.

Referring now to the drawing, and especially to FIGS. 1 through 3 thereof, a modular apparatus constructed in accordance with the present invention is shown at 20 and is seen to include plural tiers 22 and 24 for displaying and dispensing merchandise at a point-of-purchase 26 adjacent a display shelf 28 extending in lateral directions 30. The merchandise is illustrated in the form of packages 32 and 34 arranged serially along corresponding paths of travel 36 and 38 spaced apart altitudinally and extending in longitudinal directions parallel to a longitudinal axis of the modular apparatus 20 as depicted at 40, with the packages 32 and 34 biased toward corresponding forward dispensing locations 42 and 44 spaced apart altitudinally and placed at the point-of-purchase 26, as will be described in detail below. The plural tiers 22 and 24 are placed vertically above the display shelf 28, tier 22 being a lower tier, while tier 24 is an upper tier, with the packages 32 and 34 arranged along the corresponding lower and upper paths of travel 36 and 38, stacked vertically above display shelf 28, so as to take advantage of the vertical space available above display shelf 28 to accommodate a greater number of packages 32 and 34 within a given lateral extent of the display shelf 28. In the illustrated embodiment, apparatus 20 is seen to include plural bays 50 extending side-by-side along the lateral directions 30, with each bay 50 having plural tiers 22 and 24 so as to maximize utilization of the space available along display shelf 28.

Each bay includes a lower pusher-track assembly 52 having a basal tray 54 extending in the longitudinal directions for supporting the series of packages 32 along the corresponding path of travel 36, with the packages 32 biased forward, toward dispensing location 42, by a pusher 56 and a biasing spring 58, to engage the forward-most package 32F against a stop 60, in a manner fully described in connection with the pusher-track assembly disclosed in U.S. Pat. No. 7,424,957, the disclosure of which is incorporated herein by reference thereto. Suffice it to say that forward-most package 32F is biased into the position shown in FIGS. 1 through 3, where the package 32F is displayed in position in dispensing location 42 at the point-of-purchase 26 for viewing and selection by a purchaser who readily may grasp and remove package 32F, which then will be replaced at the dispensing location 42 by the next-consecutive package 32, in a now conventional manner.

A securing arrangement 66 secures the lower pusher-track assembly 52 to the display shelf 28, the securing arrangement 66 including a retainer plate 70 affixed to the display shelf 28, extending in the lateral directions 30 within a basal plane 71 and having a multiplicity of laterally spaced apart grooves 72 extending longitudinally between laterally extending shoulders 74. As described more fully in the aforesaid U.S. Pat. No. 7,424,957, a pair of tongues 76 depend from pusher-track assembly 52 and are engaged with counterpart grooves 72 to establish a selected lateral location of pusher-track assembly 52 along display shelf 28, and a pair of fingers 78 depend from the pusher-track assembly 52 and are engaged with shoulders 74 extending laterally along retainer plate 70 to capture pusher-track assembly 52 upon retainer plate 70. At the same time, a pair of keys 80 enter counterpart keyways 82 which extend in lateral directions along the retainer plate 70 such that the engagement of the tongues 76 with counterpart grooves 72 and the engagement of the keys 80 with counterpart keyways 82, in conjunction with the grasp of the fingers 78 with the shoulders 74 of the retainer plate 70, secure and stabilize the pusher-track assembly 52 in the selected lateral location along the display shelf 28.

With the lower pusher-track assembly 52 affixed in place along the display shelf 28, a divider is affixed adjacent each side of the lower pusher-track assembly 52 so as to straddle the lower pusher-track assembly 52 with a pair of dividers toward establishing a bay 50. Thus, looking first at the right-hand bay 50, a right-side divider 90 is affixed to the display shelf 28 in juxtaposition with the right side of the lower pusher-track assembly 52. A central divider 92 is affixed to the display shelf 28 in juxtaposition with the left side of the lower pusher-track assembly 52. An upper pusher-track assembly 96 is secured to each of the right-side divider 90 and the central divider 92, elevated altitudinally above the lower pusher-track assembly 52, and includes a basal tray 98 extending in the longitudinal directions for supporting the series of packages 34 along the corresponding path of travel 38, with the packages 34 biased forward, toward dispensing location 44, by a pusher 100 and a biasing spring 102, to engage the forward-most package 34F against a stop 104, in a now conventional manner. Forward-most package 34F is biased into the position shown in FIGS. 1 through 3, where the package 34F is displayed in position in dispensing location 44 at the point-of-purchase 26 for viewing and selection by a purchaser who readily may grasp and remove package 34F, which then will be replaced at the dispensing location 44 by the next-consecutive package 34.

Turning now to FIGS. 4 through 7, the right-side divider 90 extends longitudinally from a far end, shown as a rear end 110, to a near end, shown as a front end 112, and altitudinally from a lower edge 114 to an upper edge 116, and includes laterally opposite faces 118. A base 120 extends longitudinally along the lower edge 114 and is reinforced by longitudinally spaced apart ribs 122 to establish a firm support for divider 90 upon placement of the divider 90 upon the display shelf 28. The central divider 92 extends longitudinally from a far end, shown as a rear end 130, to a near end, shown as a front end 132, and altitudinally from a lower edge 134 to an upper edge 136, and includes laterally opposite faces 138. A base 140 extends longitudinally along the lower edge 134 and is reinforced by longitudinally spaced apart ribs 142 to establish a firm support for divider 92 upon placement of the divider 92 upon the display shelf 28.

Figure 4:
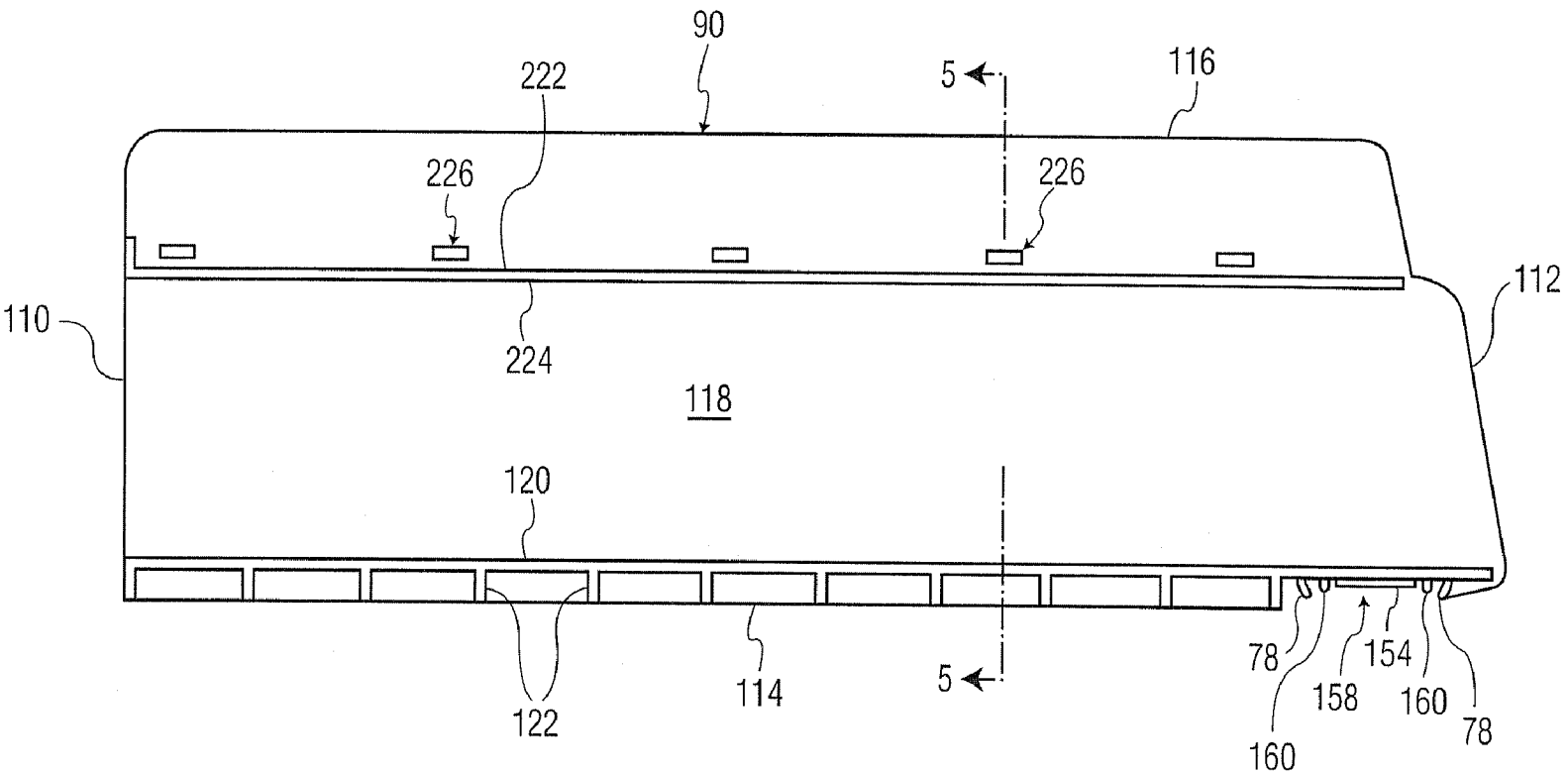
FIG. 4 is a side elevational view of a right-side component part of the apparatus.
Figure 5:
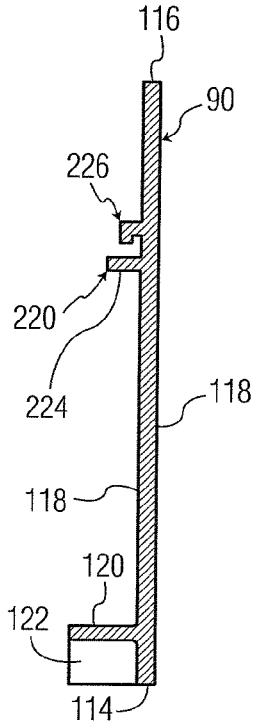
FIG. 5 is a cross-sectional view taken along line 5-5 of FIG. 4.
Figure 6:
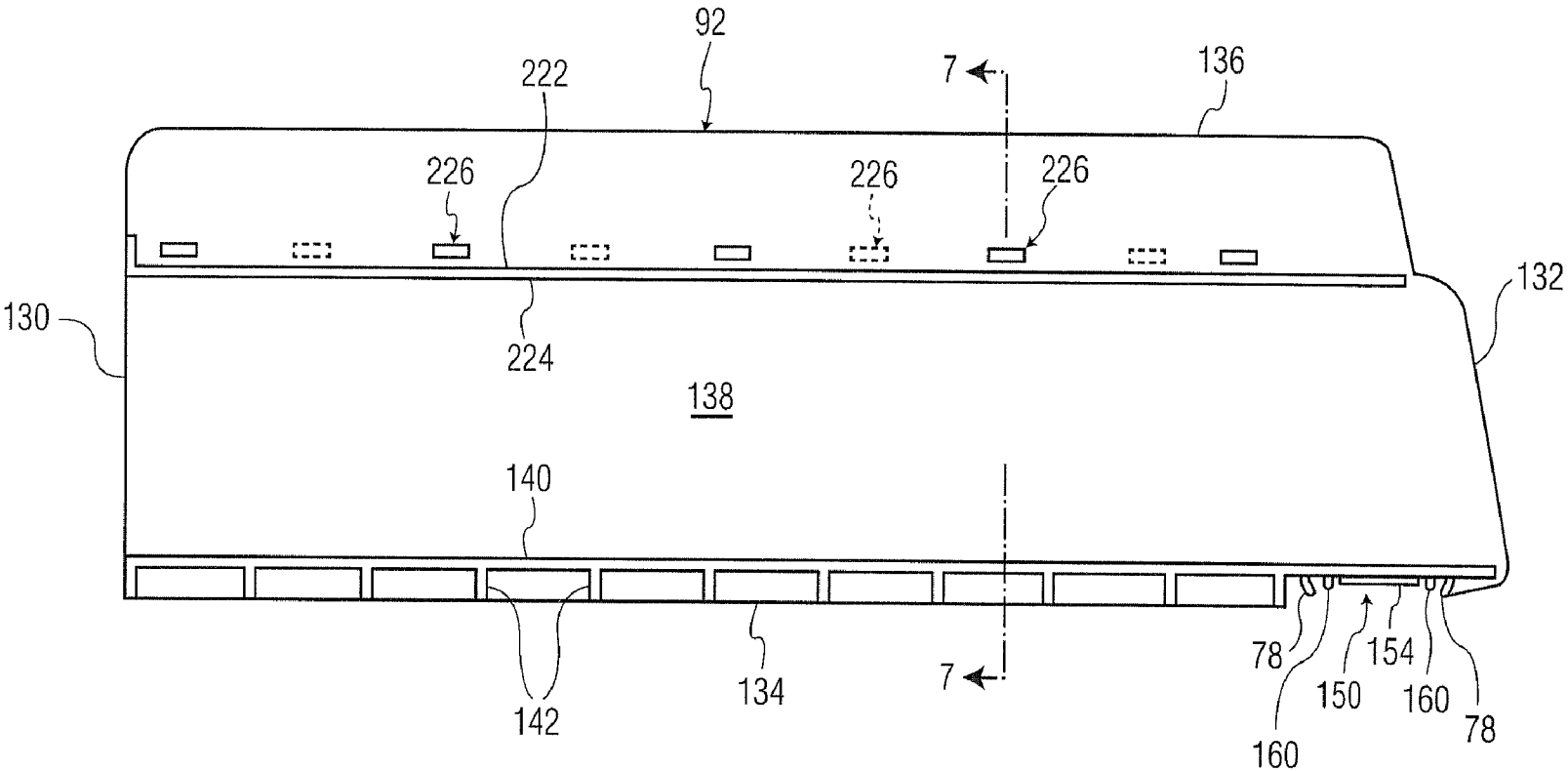
FIG. 6 is a side elevational view of a center component part of the apparatus.
Figure 7:
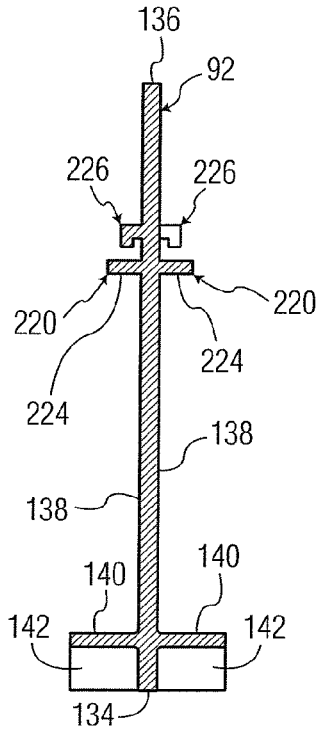
FIG. 7 is a cross-sectional view taken along line 7-7 of FIG. 6.
Figure 8:
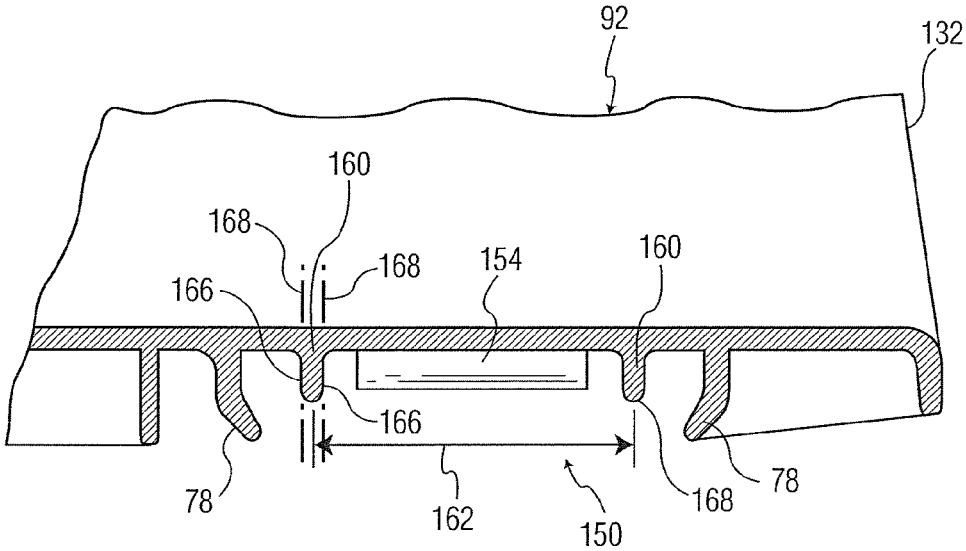
FIG. 8 is an enlarged fragmentary view of a front end portion of the center component of FIG. 6.
Figure 9:
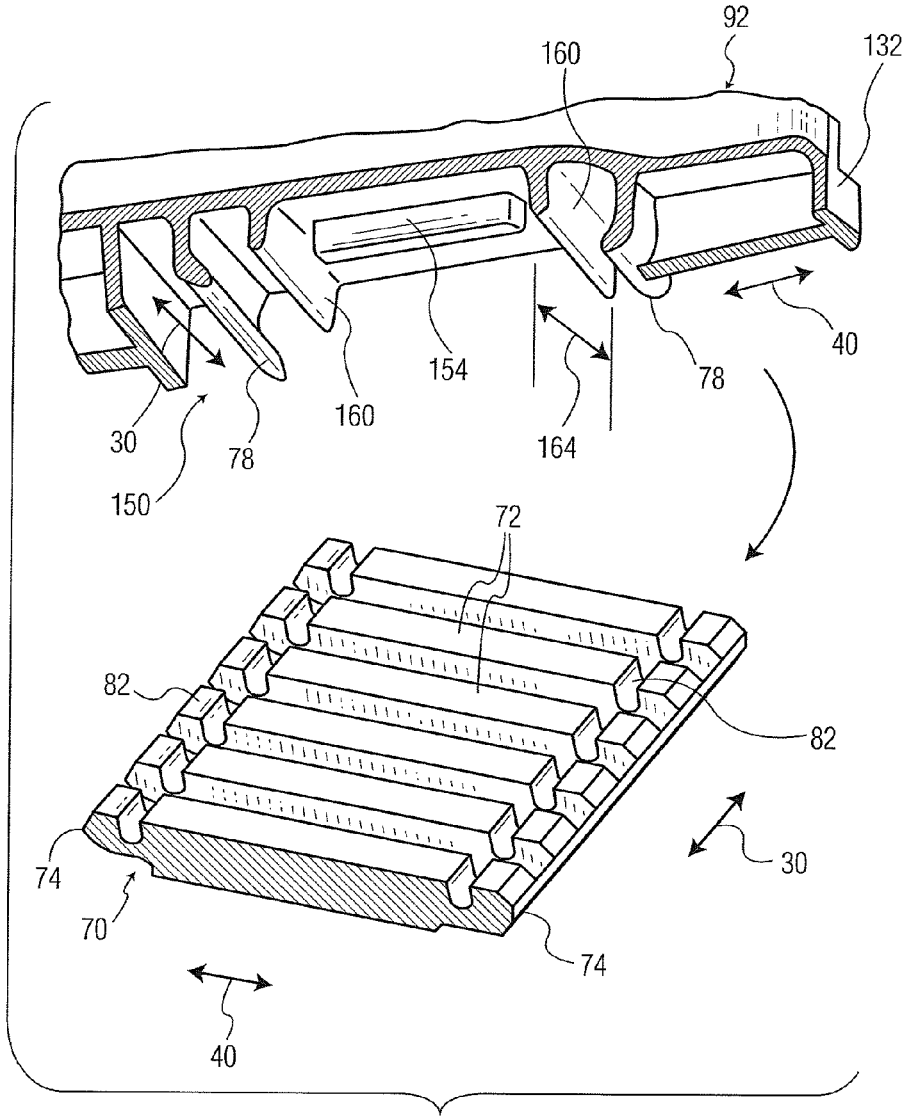
FIG. 9 is an exploded, fragmentary pictorial view showing the component part of FIGS. 6 through 8 being integrated into the apparatus.

Each of the dividers 90 and 92 is secured selectively to the display shelf 28 by a divider-securing arrangement, the divider-securing arrangements being similar to the securing arrangement 66 which secures the lower pusher-track assembly 52 to the display shelf 28. Thus, as best described in connection with FIGS. 8 and 9, a divider-securing arrangement 150 is located adjacent front end 132 of center divider 92 and is seen to include the retainer plate 70 which is affixed to shelf 28, as by threaded fasteners 152 (see FIG. 1), and provides forward and rearward shoulders 74 extending along the shelf 28 in lateral directions 30 transverse to the longitudinal directions. Corresponding forward and rearward fingers 78 are carried by the divider 92 and are engaged with respective shoulders 74 to hold the divider 92 juxtaposed with shelf 28. At the same time, a tongue 154, integral with and depending from the divider 92, between the fingers 78, to engage a selected groove 72 of a plurality of grooves 72 spaced apart laterally along the retainer plate 70 to place divider 92 at a selected location along the retainer plate 70. Divider 90 is secured to retainer plate 70 with a similar divider-securing arrangement 158 which includes depending fingers 78 and a tongue 154, as seen in FIG. 4.

Each divider 90 and 92 is stabilized by a further stabilizing arrangement against movements of the respective rear ends 110 and 130 of the dividers 90 and 92 in the lateral directions 30 within basal plane 71. Each divider stabilizing arrangement includes a pair of keys 160 extending in the lateral directions 30, preferably along and integral with each divider 90 and 92, projecting downwardly, adjacent respective front ends 112 and 132, for engagement with a counterpart pair of keyways, the preferred counterpart pair of keyways being coincident with the pair of keyways 82 extending in the lateral directions 30, preferably along retainer plate 70. The keys 160 and keyways 82 are dimensioned and configured for complementary interengagement, with each key 160 to be fully engaged with a counterpart complementary keyway 82 when the dividers 90 and 92 are secured in place along the retainer plate 70.

The keys 160 are spaced apart in longitudinal directions by a predetermined longitudinal spacing 162, as are keyways 82, so that the keys 160 can be fitted within corresponding keyways 82 in a longitudinally interlocked relationship. The keys 160 provide prescribed lateral spans 164 over which the keys 160 and keyways 82 are to be engaged. Upon interlocking keys 160 with counterpart keyways 82, the longitudinal spacing 162 is great enough and the lateral spans 164 are extensive enough such that, in conjunction with the engagement of each tongue 154 with a counterpart groove 72, canting of each divider 90 and 92 relative to the retainer plate 70 essentially is precluded, within the basal plane 71, as is concomitant movements of the rear ends 110 and 130 in lateral directions 30 within the basal plane 71, thereby maintaining the dividers 90 and 92 in the desired longitudinal alignment alongside the paths of travel 36 and 38 of merchandise packages 32 and 34. At the same time, alignment of the keys 160 and keyways 82 along the lateral directions 30, together with the continuous extension of the keyways 82 along the retainer plate 70, enables selective placement of each divider 90 and 92 at any selected location along retainer plate 70 permitted by the engagement of a tongue 154 with a groove 72.

Figure 10:
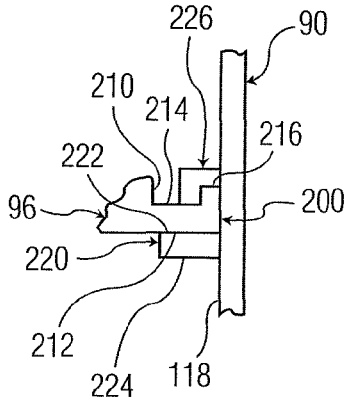
FIG. 10 is an enlarged, fragmentary view of a portion of the apparatus indicated by arrow 10 in FIG. 2.
Figure 11:
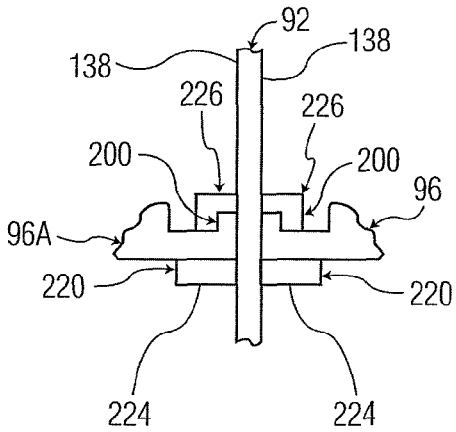
FIG. 11 is an enlarged, fragmentary view of another portion of the apparatus indicated by arrow 11 in FIG. 2.

The preferred cross-sectional configuration of the keys 160 and keyways 82 is one which provides surfaces 166 extending within engagement planes 168 generally normal to the basal plane 71. Such a cross-sectional configuration establishes a snug fit between keys 160 and keyways 82 for precluding the aforesaid canting, while enabling ease in the selective insertion of keys 160 into keyways 82 and selective withdrawal of keys 160 from keyways 82 in altitudinal directions, normal to the basal plane 71, for placing each divider 90 and 92 at a selected location along the retainer plate 70. Keys 160 are provided with rounded edges 169 for facilitating insertion of the keys 160 into counterpart keyways 82. Referring now to FIGS. 10 and 11, as well as to FIGS. 2 and 3, upper pusher-track assembly 96 is secured to each of the dividers 90 and 92 by means of a securing arrangement which affixes the pusher-track assembly 96 to each of the dividers 90 and 92 at a level elevated altitudinally above the lower pusher-track assembly 52. To that end, pusher-track assembly 96 includes track retainers 200 extending longitudinally along laterally opposite borders 210 of the basal tray 98, the track retainers 200 each providing a support surface 212 extending in longitudinal directions, preferably essentially from end to end of the basal tray 98, and including an engagement member shown in the form of a web 214 and a flange 216, both extending longitudinally, preferably all along the track retainer 200, with the flange 216 raised upwardly from the web 214 to establish a generally L-shaped transverse cross-sectional configuration. Similarly, dividers 90 and 92 include corresponding divider retainers 220 extending longitudinally along confronting faces 118 and 138, the divider retainers providing corresponding support surfaces 222 along a rail 224 extending in longitudinal directions, preferably essentially from end to end of each divider 90 and 92, and including engagement members shown in the form of longitudinally spaced apart hook members 226 projecting from the confronting faces 118 and 138 and having a generally L-shaped transverse cross-sectional configuration essentially complementary to the L-shaped transverse cross-sectional configuration of the engagement members of the pusher-track retainers 200.

As seen in FIGS. 10 and 11, with reference as well to FIGS. 1 and 2, upon engagement of track retainers 200 with divider retainers 220, support surfaces 212 and 222 are juxtaposed, with support surface 212 resting upon support surface 222, and the respective engagement members are engaged with one-another to interlock the respective L-shaped configurations, thereby supporting the upper pusher-track assembly 96 in place above the lower pusher-track assembly 52, and securing the upper pusher-track assembly 96 and the dividers 90 and 92 against movement relative to one-another in altitudinal directions and in lateral directions, to establish the plural-tiered arrangement of apparatus 20. In order to complete the two-bayed arrangement of the illustrated embodiment, a left-side divider 240 having a construction which is the mirror-image of right-side divider 90, is assembled with a second upper pusher-track assembly 96A, with the center divider 92 and the left-side divider 240 straddling a second lower pusher-track assembly 96A to establish a second bay 50 contiguous with the first bay 50.

It is noted that center divider 92 includes divider retainers 220 projecting from each face 138, thus enabling the construction of side-by-side bays 50, as described above. Any number of side-by-side bays can be assembled utilizing combinations of center dividers 92 and side dividers 90 and 240. Where it is desired to assemble only a single bay 50, a single lower pusher-track assembly 52 and a single upper pusher-track assembly 96 can be placed between a single right-side divider 90 and a single left-side divider 240, without a center divider 92, with the upper pusher-track assembly 96 assembled to the side dividers 90 and 240, thereby establishing a single bay.

It will be seen that the present invention attains all of the objects and advantages summarized above, namely: Provides modular display and dispensing apparatus for attaining enhanced utilization of space available at assigned linear lengths of display shelf space in a retail sales environment, employing pusher-track feed systems; enables efficient and effective display and dispensing of merchandise articles, utilizing pusher-track feed at point-of-purchase locations where linear shelf space is limited; establishes an aesthetically attractive and efficient use of assigned shelf space, with increased capacity and added convenience in utilizing a modular arrangement of pusher-track assemblies to feed merchandise articles at such shelf locations; facilitates the organization of merchandise for display and dispensing at a point-of-purchase located along store shelves; provides simplified plural-tiered pusher-track apparatus constructed economically of fewer component parts; allows ease of set-up and use for accommodating a wide variety of merchandise displayed and dispensed along plural tiers at a point-of-purchase; enables pusher-track feed of merchandise articles along plural tiered paths of travel toward corresponding plural dispensing locations for more versatile dispensing of such merchandise articles; makes more efficient use of space available along display shelf locations, with pusher-track feed display and dispensing ofinerchandise articles offered for sale at such locations; increases the capacity available for pusher-track feed in display and dispensing apparatus placed upon a display shelf at a point-of-purchase location, without requiring an increase in the length of shelf space occupied by the display and dispensing apparatus; provides the versatility of modular construction in a plural-tiered pusher-track display and dispensing apparatus; minimizes the number and complexity of component parts in a modular display and dispensing apparatus which provides plural dispensing tiers for better space utilization; provides a modular pusher-track feed display and dispensing apparatus of increased capacity at a given display shelf location for reliable operation over an extended service life.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A modular apparatus for displaying and dispensing merchandise at plural dispensing tiers at a point-of-purchase adjacent a display shelf extending in lateral directions, the merchandise being in the form of packages arranged serially along each of at least first and second paths of travel spaced apart altitudinally and extending along a longitudinal direction which is parallel to a longitudinal axis of the modular apparatus toward corresponding first and second forward dispensing locations spaced apart altitudinally and placed at the point-of -purchase, the apparatus comprising:

a first pusher-track assembly for extending in the longitudinal direction along the first path of travel in juxtaposition with first serially arranged packages, the first pusher-track assembly including a first pusher movable along the first path of travel toward a first stop adjacent the first forward dispensing location, and a first biasing spring biasing the first pusher toward the first stop;

a first securing arrangement for securing the first pusher-track assembly at a selected lateral location along the display shelf;

at least two dividers for extending each in the longitudinal direction, spaced apart in a lateral direction, to straddle the first path of travel, in juxtaposition with the first serially arranged packages, each divider including a lower edge for juxtaposition with the display shelf and an upper edge for being spaced altitudinally above the display shelf when the lower edge is juxtaposed with the display shelf;

a divider-securing arrangement for securing each divider at a selected divider lateral location along the display shelf;

a second pusher-track assembly for extending in the longitudinal direction along the second path of travel in juxtaposition with second serially arranged packages, the second pusher-track assembly including a second pusher movable along the second path of travel toward a second stop adjacent the second forward dispensing location, and a second biasing spring biasing the second pusher toward the second stop; and a second securing arrangement for selectively securing the second pusher-track assembly to each of the dividers, elevated altitudinally above the first pusher-track assembly, and placed altitudinally between the lower edge and the upper edge of each divider to extend along the second path of travel, such that upon securing the dividers in place, each along the longitudinal direction, straddling the first path of travel, and securing the second pusher-track assembly between the dividers, the divider-securing arrangement and the second securing arrangement will integrate the second pusher-track assembly with the dividers within the apparatus, with the first and second forward dispensing locations spaced apart altitudinally to establish the plural dispensing tiers at the point-of-purchase.

2. The apparatus of claim 1 wherein:

the second pusher-track assembly includes laterally opposite borders, and a first support surface extending along each border; and each divider includes laterally opposite faces extending along corresponding longitudinal and altitudinal directions of the dividers, between the lower and upper edges of each divider, and a second support surface extending along one of the laterally opposite faces of each divider, attitudinally intermediate the lower and upper edges of the dividers;

the second support surfaces of the dividers confronting one-another upon securement of the dividers at the selected lateral locations along the display shelf for juxtaposition of each second support surface with a corresponding first support surface to support the second pusher-track assembly between the dividers, along the second path of travel.

3. The apparatus of claim 2 wherein each divider includes a rail extending along the laterally opposite face having the second support surface, and each second support surface extends along the corresponding rail.

4. The apparatus of claim 3 wherein the second securing arrangement includes:

track retainers on the second pusher-track assembly, the track retainers including first engagement members; and divider retainers on the dividers, the divider retainers including second engagement members for being engaged with the first engagement members upon juxtaposition of the first support surfaces with the second support surfaces;

the first and second engagement members being dimensioned and configured such that upon juxtaposition of the first and second support surfaces and engagement of the first and second engagement members, the second pusher-track assembly and the dividers will be secured against movement relative to one-another in lateral and altitudinal directions.

5. The apparatus of claim 4 wherein:

the first engagement members include a web projecting laterally from a corresponding border of the second pusher-track assembly, and extending along the corresponding border; and a flange extending along the web and projecting from the web in an altitudinal direction;

the web and the flange establishing a first generally L-shaped transverse cross-sectional configuration; and the second engagement members project laterally from a corresponding one of the laterally opposite faces and include a second generally L-shaped transverse cross-sectional configuration complementary to the first transverse cross-sectional configuration for engagement with the first transverse cross-sectional configuration to preclude movement of the pusher-track assembly and the dividers relative to one-another in the lateral and altitudinal directions.

6. The apparatus of claim 5 wherein:

at least one of the two dividers includes a further rail extending along the laterally opposite face of the divider opposite to the face of the divider having the rail, and a further second support surface extends along the further rail; and further second engagement members project laterally from the laterally opposite face of the divider having the further rail; and the apparatus includes a third divider for being secured at a further selected divider lateral location along the display shelf, spaced laterally from the divider having the futher rail, the third divider having a face for confronting the face of the divider having the further rail, and including a further support surface extending along the face of the third divider and further engagement members projecting from the face of the third divider for securing a further pusher-track assembly to each of the further divider and the divider having the further rail, between the third divider and the divider having the further rail, to establish a further path of travel extending toward a further forward dispensing location placed at the point-of-purchase, the further pusher-track assembly including a further pusher movable along the further path of travel toward a further stop adjacent the further forward dispensing location, and a further biasing spring biasing the further pusher toward the further stop.

7. A modular apparatus for displaying and dispensing merchandise at plural dispensing tiers at a point-of-purchase adjacent a display shelf extending in lateral directions, the merchandise being in the form of packages arranged serially along each of at least first and second paths of travel spaced apart altitudinally and extending along a longitudinal direction which is parallel to a longitudinal axis of the modular apparatus, toward corresponding first and second forward dispensing locations spaced apart altitudinally and placed at the point-of-purchase, the apparatus comprising:

a first pusher-track assembly for extending in the longitudinal direction along the first path of travel in juxtaposition with first serially arranged packages;

a first securing arrangement for securing the first pusher-track assembly at a selected lateral location along the display shelf;

at least two dividers for extending each in the longitudinal direction, spaced apart in a lateral direction, to straddle the first path of travel, in juxtaposition with the first serially arranged packages, each divider including a lower edge for juxtaposition with the display shelf and an upper edge for being spaced altitudinally above the display shelf when the lower edge is juxtaposed with the display shelf;

a divider-securing arrangement for securing each divider at a selected divider lateral location along the display shelf;

a second pusher-track assembly for extending in the longitudinal direction along the second path of travel in juxtaposition with second serially arranged packages; and a second securing arrangement for selectively securing the second pusher-track assembly to each of the dividers, elevated altitudinally above the first pusher-track assembly, and placed altitudinally between the lower edge and the upper edge of each divider to extend along the second path of travel, such that upon securing the dividers in place, each along the longitudinal direction, straddling the first path of travel, and securing the second pusher-track assembly between the dividers, the divider-securing arrangement and the second securing arrangement will integrate the second pusher-track assembly with the dividers within the apparatus, with the first and second forward dispensing locations spaced apart altitudinally to establish the plural dispensing tiers at the point-of-purchase;

the first pusher-track assembly including a near end for placement adjacent the first and second forward dispensing locations, and a far end spaced away from the near end along the longitudinal direction;

the first securing arrangement being dimensioned and configured for securing the near end of the first pusher-track assembly at the selected lateral location, with the first pusher -track assembly extending in a basal plane, and the near end affixed against inadvertent movement in lateral directions within the basal plane, as well as against inadvertent movement in the longitudinal direction within the basal plane;

each divider includes a near end for placement adjacent the corresponding first and second forward dispensing locations, and a far end spaced away from the near end in the longitudinal direction;

the divider-securing arrangement is located for securing the near end of each divider at the selected divider lateral location, within the basal plane, with the near end affixed against inadvertent movement in lateral directions within the basal plane, the divider-securing arrangement including a retainer plate for affixation to the display shelf with the retainer plate extending along the lateral directions adjacent the point-of-purchase; and a stabilizing arrangement for stabilizing each divider against inadvertent movements of the far end in lateral directions within the basal plane when the near end is secured at the selected divider lateral location, the stabilizing arrangement including:

a pair of keys extending in lateral directions along one of the retainer plate and each divider, adjacent the near end of each divider;

a pair of keyways extending in lateral directions along the other of the retainer plate and each divider, adjacent the near end of each divider, each keyway being complementary to a corresponding key;

a tongue extending in the longitudinal direction along one of the retainer plate and each divider, adjacent the near end of each divider and placed intermediate corresponding keys; and a groove extending in the longitudinal direction along the other of the retainer plate and each divider, adjacent the near end of each divider, the grooves being complementary to the tongues;

the keys and the keyways, and the tongues and the grooves, being dimensioned and configured for complementary interengagement, with each key interlocked with a complementary keyway, and each tongue interlocked with a complementary groove, the keys being spaced apart and the keyways being spaced apart in the longitudinal direction by a predetermined spacing in the longitudinal direction, and engaged along a prescribed lateral length, and each tongue extending along a prescribed length in the longitudinal direction, the prescribed lateral length being long enough and the prescribed length in the longitudinal direction being long enough such that upon engagement of the complementary keys and keyways, and engagement of the complementary tongues and grooves, canting of the dividers relative to the retainer plate within the basal plane essentially is precluded and the dividers are stabilized, in alignment with the longitudinal direction.

8. The apparatus of claim 7 wherein the keys and the tongues are on the dividers, and the keyways and the grooves are in the retainer plate.

9. The apparatus of claim 8 wherein the keys and the keyways include confronting engaging surfaces extending in key and keyway engagement planes generally normal to the basal plane, and the tongues and the grooves include further confronting engaging surfaces extending in further engagement planes generally normal to the basal plane.

10. The apparatus of claim 9 wherein the further engagement planes are generally normal to the key and keyway engagement planes.

11. The apparatus of claim 7 wherein:

the second pusher-track assembly includes laterally opposite borders, and a first support surface extending along each border; and each divider includes laterally opposite faces extending along corresponding longitudinal and altitudinal directions of the dividers, between the lower and upper edges of each divider, and a second support surface extending along at least one of the laterally opposite faces of each divider, altitudinally intermediate the lower and upper edges of the dividers;

the second support surfaces of the dividers confronting one-another upon securement of the dividers at the selected divider lateral locations along the display shelf for juxtaposition of each second support surface with a corresponding first support surface to support the second pusher-track assembly between the dividers, adjacent the second path of travel.

12. The apparatus of claim 11 wherein each divider includes a rail extending along the laterally opposite face having the second support surface, and each second support surface extends along the corresponding rail.

13. The apparatus of claim 12 wherein the second securing arrangement includes:

track retainers on the second pusher-track assembly, the track retainers including first engagement members; and divider retainers on the dividers, the divider retainers including second engagement members for being engaged with the first engagement members upon juxtaposition of the first support surfaces with the second support surfaces;

the first and second engagement members being dimensioned and configured such that upon juxtaposition of the first and second support surfaces and engagement of the first and second engagement members, the second pusher-track assembly and the dividers will be secured against movement relative to one-another in lateral and altitudinal directions.

14. The apparatus of claim 13 wherein:

at least one of the two dividers includes a further rail extending along the laterally opposite face of the divider opposite to the face of the divider having the rail, and a further second support surface extends along the further rail; and further second engagement members project laterally from the laterally opposite face of the divider having the further rail; and the apparatus includes a third divider for being secured to the display shelf, spaced laterally from the divider having the further rail, the third divider having a face for confronting the face of the divider having the further rail, and including a further support surface extending along the face of the third divider and further engagement members projecting from the face of the third divider for securing a further pusher -track assembly to each of the further divider and the divider having the futher rail, between the third divider and the divider having the further rail, to establish a further path of travel extending toward a further forward dispensing location placed at the point-of-purchase.

15. The apparatus of claim 14 wherein the keys and the tongues are on the dividers, and the keyways and the grooves are in the retainer plate.

16. The apparatus of claim 15 wherein the keys and the keyways include confronting engaging surfaces extending in key and keyway engagement planes generally normal to the basal plane, and the tongues and the grooves include further confronting engaging surfaces extending in further engagement planes generally normal to the basal plane.

17. The apparatus of claim 16 wherein the further engagement planes are generally normal to the key and keyway engagement planes.

* * * * *